US005913609A

United States Patent [19]

Lorenzi et al.

[11] Patent Number: 5,913,609

[45] Date of Patent: Jun. 22, 1999

[54] APPARATUS AND METHOD FOR CONVEYING A PROTECTIVE COVER ALONG A TOILET SEAT

[75] Inventors: Yossi Lorenzi, Ramat Gan; Arie Spokoiny, Nof Aialon, both of Israel

[73] Assignee: L.T.R. Lorenzi Technological Resources Ltd., Ramat Gan, Israel

[21] Appl. No.: 08/780,354

[22] Filed: Jan. 8, 1997

[51] Int. Cl.[6] ..... A47K 13/22

[52] U.S. Cl. ..... 4/243.3; 4/243.1

[58] Field of Search ..... 4/243.1, 243.2, 4/243.3, 237

[56] References Cited

U.S. PATENT DOCUMENTS

| | | | |
|---|---|---|---|
| 1,037,062 | 8/1912 | Seyl | 4/237 |
| 1,516,222 | 11/1924 | Van Doren | 4/243.1 |
| 4,213,212 | 7/1980 | Hefty et al. | 4/243.2 |
| 4,566,648 | 1/1986 | Hefty et al. | 4/243.3 |
| 4,926,506 | 5/1990 | Wang | 4/243.1 |
| 4,928,325 | 5/1990 | Higuchi et al. | 4/243.3 |
| 5,253,372 | 10/1993 | Boker | 4/243.2 |
| 5,438,711 | 8/1995 | Higuchi et al. | 4/243.3 |
| 5,561,867 | 10/1996 | Roginsky . | |

FOREIGN PATENT DOCUMENTS

| | | | |
|---|---|---|---|
| 0 323 801 A1 | 7/1989 | European Pat. Off. . | |
| 0323801 | 7/1989 | European Pat. Off. | 4/243.2 |
| 532 094 | 1/1922 | France . | |
| 2 603 315 | 3/1988 | France . | |
| 254 916 | 6/1991 | Germany . | |

*Primary Examiner*—Robert M. Fetsuga
*Attorney, Agent, or Firm*—McDermott, Will & Emery

[57] ABSTRACT

Apparatus for conveying a protective covering along a toilet seat is provided. The apparatus includes a housing containing a supporting structure for the toilet seat, a feeder spool from which a roll of unused protective covering material is fed, a take-up spool for used protective covering and a drive mechanism operated by a water supply system to advance a pre-determined length of the protective covering along the toilet seat, which length generally corresponds to the perimeter of the toilet seat.

10 Claims, 5 Drawing Sheets

APPARATUS AND METHOD FOR CONVEYING A PROTECTIVE COVER ALONG A TOILET SEAT

FIELD OF THE INVENTION

The present invention relates to a protective covering for a toilet seat and apparatus for supplying the covering.

BACKGROUND OF THE INVENTION

The problems of hygiene associated with the use of toilet seats are well known. It is also well known to use a disposable covering which can be thrown or flushed away. Apparatus has also been developed for automatically feeding a portion of the covering on request.

Generally, such dispensing apparatus includes a mechanism for feeding the seat covering paper onto the seat and thence to a take-up roll.

U.S. Pat. No. 4,213,212 to Hefty et al. describes an arrangement for fitting and changing a tubular cover made of plastic film on a toilet seat, and a method for forming a tube A tubular toilet seat cover is stored on a reel and pulled off from this reel as it is replaced, and the used cover is taken up on another reel. By actuating a drive mechanism, the cover is moved through a predetermined distance in such manner that when it is in the mounted position, the toilet seat body is surrounded by the tubular cover and the cover covers the important part of the toilet seat. The toilet seat, drive mechanism and storage device constitute a structural unit which is mountable as a whole on a conventional toilet seat, or it may constitute a unit with a toilet seat.

U.S. Pat. No. 4,566,648 to Hefty et al. describes a device for applying and conveying a protective cover for a toilet seat. This device, which is generally similar to that described in U.S. Pat. No. 4,213,212, with the addition of actuating switch apparatus includes an unwinding spool which is supported by a switch tube which passes through it and which transmits the movement of a push button, protruding from the housing, to a switch arranged inside the housing. The unwinding spool can rotate loosely on the switch tube and is essentially independent from the switch tube's axial motion.

U.S. Pat. No. 4,928,325 to Higuchi et al. describes a toilet seat structure capable of automatically feeding a seat covering paper onto the toilet seat has paper feeding mechanism and a paper cutting mechanism operated by an electronic control unit. A specified length of paper appropriate for covering the toilet seat is automatically and accurately fed and positioned on the toilet seat. After use, the seat covering paper can automatically be cut off. For lavatories at public sites in particular, since the user can operate the apparatus to paper feed from a functional casing to provide a new seat covering paper on the toilet seat for each use, the user can be assured of a clean toilet seat. Also since the seat covering paper is held immovably on the toilet seat, the use of the paper-covered toilet is made easier.

U.S. Pat. No. 5,438,711 to Higuchi et al. describes an electrically driven seat covering paper feeding mechanism which feeds seat covering paper from a roll stored in a storage portion. A cutting mechanism cuts the seat covering paper fed to the surface of the toilet seat body at the rear edge portion of the paper. A control unit operates the electrically driven seat covering paper feeding mechanism by predetermined control signals sequentially output to control the feeding of the seat covering paper. A battery supplies electricity to the seat covering paper feeding mechanism and the control unit.

U.S. Pat. No. 5,253,372 to Boker describes apparatus for dispensing measured lengths of a sleeve material upon an armature, especially adapted for dispensing a plastic cover upon a toilet,. The apparatus includes a source of sleeve material fed onto the armature and collected upon a take-up reel. The cover is provided with a uniform series of marks along its length which are sensed and counted to control the operation of a motor drive which directs the sleeve material to and from the armature. Timer circuits are employed to cause motor cut-off if the required length of sleeve is not dispensed within a given length of time and to inhibit motor start for a fixed period after a dispensation. The sleeve-accepting end of the armature may include an angular horn to permit the sleeve to smoothly pass onto the seat.

The above-mentioned patents use electrical drive means to advance the tubular cover. Electrical means have a disadvantage of possible electrical malfunction, or of batteries running out in the case where batteries are used to supply power to the drive means. In addition, there are safety and psychological problems associated with the use of electricity in conjunction with toilets.

An addition disadvantage of the above-mentioned covers is the necessity to raise the cover to advance the roll.

SUMMARY OF THE INVENTION

An object of the present invention is to provide a protective covering for a toilet seat which overcomes the limitations and disadvantages of prior art.

A further object of the present invention is to provide apparatus for conveying a protective covering for a toilet seat which overcomes the limitations and disadvantages of prior art.

A yet further object of the present invention is to utilize a drive mechanism operated by a water supply system for operating the apparatus.

There is thus provided, in accordance with a preferred embodiment of the present invention, apparatus for conveying a protective covering along a toilet seat. The apparatus includes a housing containing a supporting structure for the toilet seat, a feeder spool from which a roll of unused protective covering material is fed, a take-up spool for used protective covering and a drive mechanism operated by a water supply system to advance a pre-determined length of the protective covering along the toilet seat, which length generally corresponds to the perimeter of the toilet seat.

Additionally, in accordance with a preferred embodiment of the present invention, the toilet seat includes first and second legs, each leg of which is connected at one end to the supporting structure. The legs are spaced a first distance apart, the first and second legs converging towards each other, whereby the legs are a second distance apart at their other end, distal from the supporting structure end and whereby the second distance being narrower than the first distance.

Furthermore, in accordance with a preferred embodiment of the present invention, the legs are interconnected to the supporting structure whereby the action of lifting one of the legs also raises the second of the legs.

Furthermore, in accordance with a preferred embodiment of the present invention, the toilet seat includes apparatus for ensuring that the protective covering remains contiguous with the seat while being advanced.

Furthermore, in accordance with a preferred embodiment of the present invention, the apparatus comprises upper and lower projecting nibs formed on one end of each of the legs, the end being distal from the supporting structure end.

Furthermore, in accordance with a preferred embodiment of the present invention, the pre-determined length of the protective covering is conveyed from the feeder spool along and on top of the first leg, at the open end of the first leg under and across the second distance, under the second leg, and along and on top of the second leg to the take-up spool.

Furthermore, in accordance with a preferred embodiment of the present invention, the water supply system is pressurized.

Additionally, in accordance with a preferred embodiment of the present invention, the drive mechanism comprises a hydraulically driven motor.

Furthermore, in accordance with a preferred embodiment of the present invention, the apparatus further includes an operating mechanism connected to the water supply system for actuating the drive mechanism.

Furthermore, in accordance with a preferred embodiment of the present invention, the operating mechanism includes a lever member, one end of which is connected to a handle and the other end of which is connected to a time controlled flow valve for automatically shutting off the flow valve after a predetermined time period.

Additionally, in accordance with a preferred embodiment of the present invention, the protective covering material is a dual-ply material.

Furthermore, in accordance with a preferred embodiment of the present invention, the dual-ply material is composed of a layer of waterproof material.

Furthermore, in accordance with a preferred embodiment of the present invention, the layer of waterproof material remains contiguous with the toilet seat.

Furthermore, in accordance with a preferred embodiment of the present invention, the take-up spool rotates in a counter-clockwise motion to the feeder spool.

Additionally, in accordance with a preferred embodiment of the present invention, there is provided a method for ensuring that one side of a protective covering remains contiguous with a toilet seat having two legs. The method includes the steps of:

a) attaching the toilet seat to a support structure containing a feeder spool and a take-up spool;
b) placing a roll of unused protective covering material on the feeder spool; and
c) advancing a pre-determined length of protective covering from the feeder spool along and on top of the toilet seat.

The advancing step includes the steps of:

a) conveying the protective covering along and on top of the first leg, the first side being contiguous with the top of the first leg;
b) at the open end of the first leg, turning over the protective covering under the first leg, the first side being contiguous with the underside of the first leg;
c) conveying the protective covering across a gap between the first and second legs;
d) at the open end of the second leg, turning over the protective covering under the second leg, the first side being contiguous with the underside of the second leg; and
e) conveying the protective covering along and on top of the second leg to the take-up spool.

Additionally, in accordance with a preferred embodiment of the present invention, there is provided a method for conveying a protective covering, having first and second sides, along a toilet seat having first and second legs, whereby the first side of the protective covering remains contiguous with the toilet seat, the method including the steps of:

a) conveying the protective covering from the feeder spool along and on top of the first leg, the first side being contiguous with the top of the first leg;
b) at the open end of the first leg, turning over the protective covering under the first leg, the first side being contiguous with the underside of the first leg;
c) conveying the protective covering across a gap between the first and second legs;
d) at the open end of the second leg, turning over the protective covering under the second leg, the first side being contiguous with the underside of the second leg; and
e) conveying the protective covering along and on top of the second leg to the take-up spool.

Furthermore, in accordance with a preferred embodiment of the present invention, the advancing step further includes the steps of rotating the feeder spool in a first direction and rotating the take-up spool in a counter-clockwise motion to the feeder spool.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
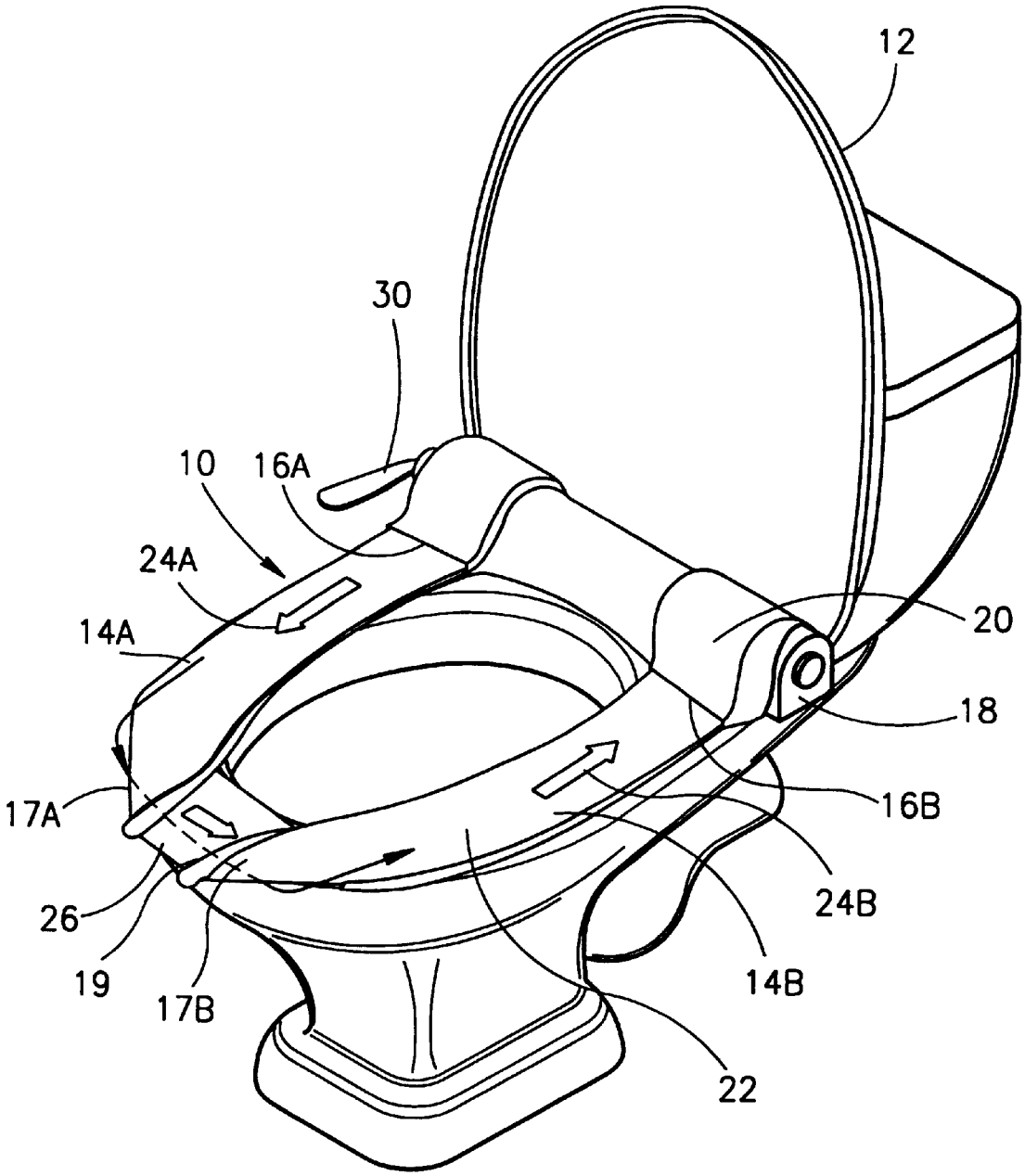
FIG. 1 is an isometric illustration of a toilet seat and cover, constructed and operative in accordance with a preferred embodiment of the present invention.
Figure 2:
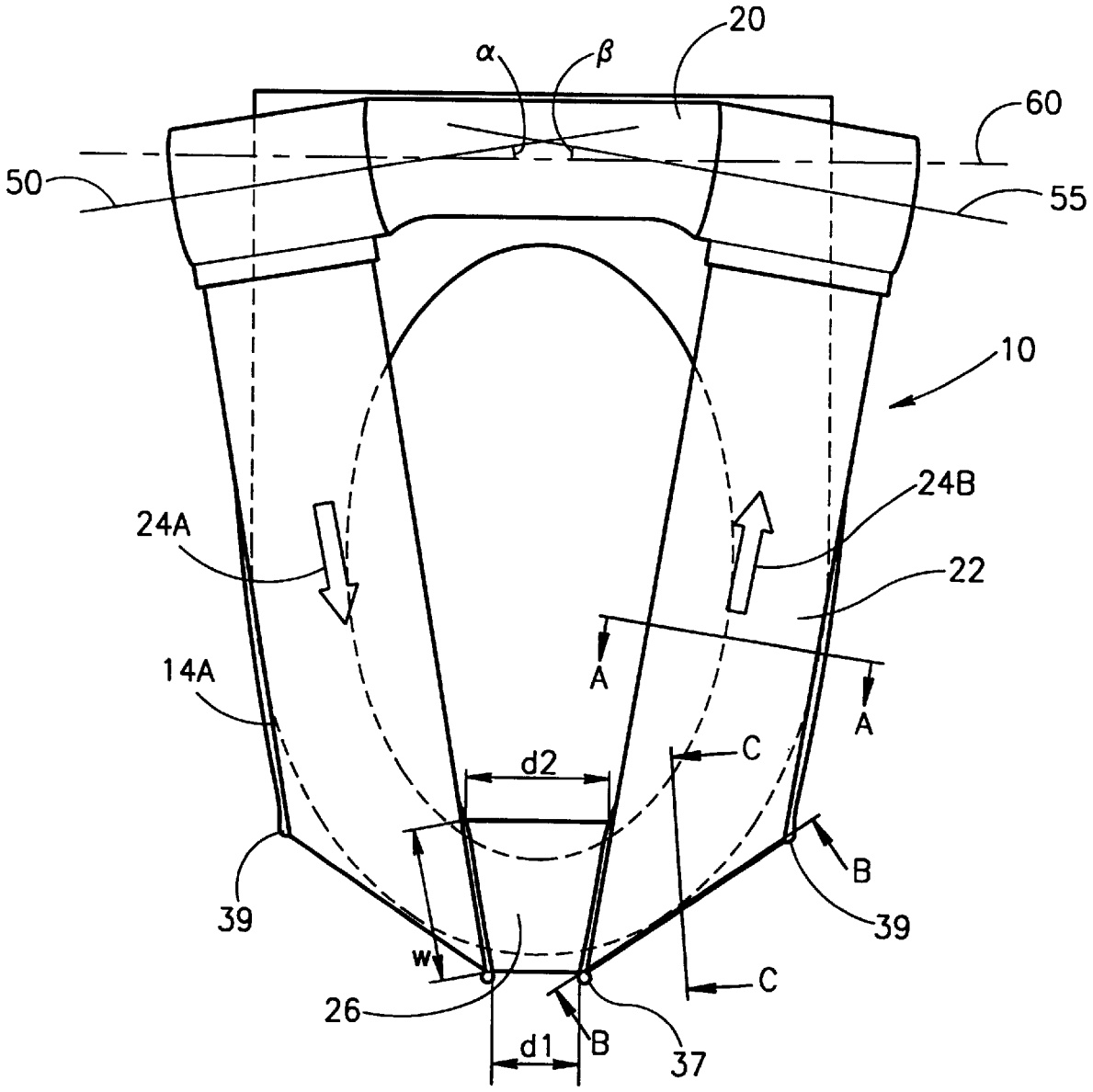
FIG. 2 is a plan view of the toilet seat of FIG. 1.
Figure 3:
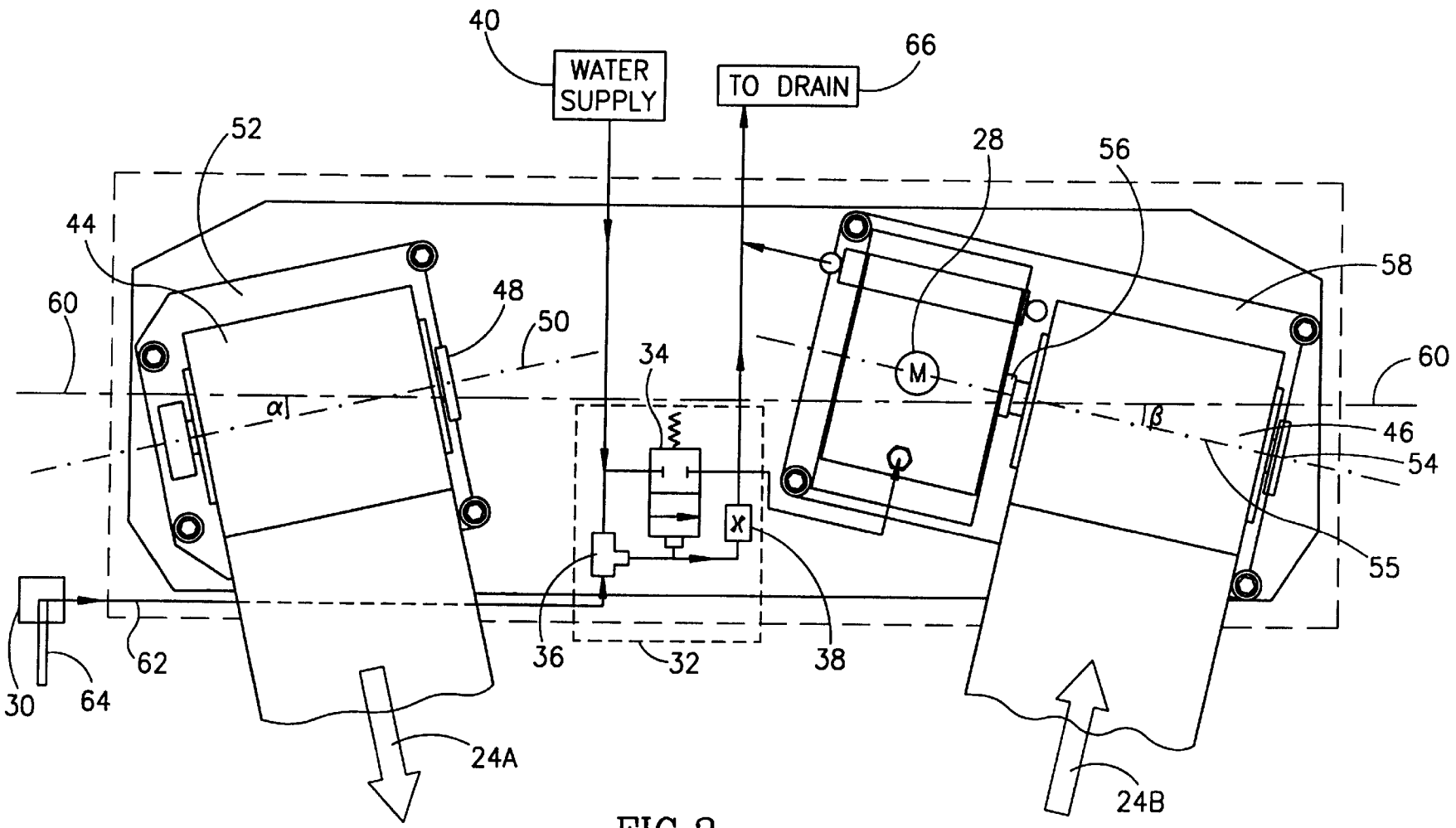
FIG. 3 is a detailed schematic arrangement of the housing of the toilet seat of FIG. 1.

Reference is made to FIGS. 1–3. FIG. 1 is an isometric illustration of a toilet seat and cover, generally referenced 10 and 12, constructed and operative in accordance with a preferred embodiment of the present invention. FIG. 2 is a plan view of the toilet seat 10 and FIG. 3 is a detailed schematic arrangement of the housing of the toilet seat.

Toilet seat 10 comprises two legs, referenced 14*a* and 14*b* which are connected at one end, referenced 16*a* and 16*b*, respectively, to a supporting structure 18. A housing 20 is provided which covers the ends 16*a* and 16*b* of legs 14*a* and 14*b*, respectively and which houses the hydraulic and mechanical components used to apply and convey the protective covering, generally designated 22 along seat 10, as indicated by arrows 24*a* and 24*b*.

Legs 14*a* and 14*b* converge towards each other, away from housing 20, so that there is a gap 26 between the other ends, referenced 17*a* and 17*b*, Is of legs 14*a* and 14*b*, respectively. Gap 26, which has a generally trapezoidal configuration (when viewed in plan—FIG. 2), bounded by sides designated "d1", "w" and "d2", where "d1" at the front of the toilet bowl 19 is less than "d2". Legs 14*a* and 14*b* are interconnected by means of supporting structure 18 so that the action of lifting one of the legs also raises the second leg.

The hydraulic and mechanical components (FIG. 3) comprise a motor 28, an operating lever 30 and a hydraulic system, generally designated 32. The hydraulic system 32 comprises a main valve 34, a timing valve 36 and a leakage valve 38 and is connected to a water supply 40. Hydraulic system 32 is also coupled to motor 28.

Figure 4A:
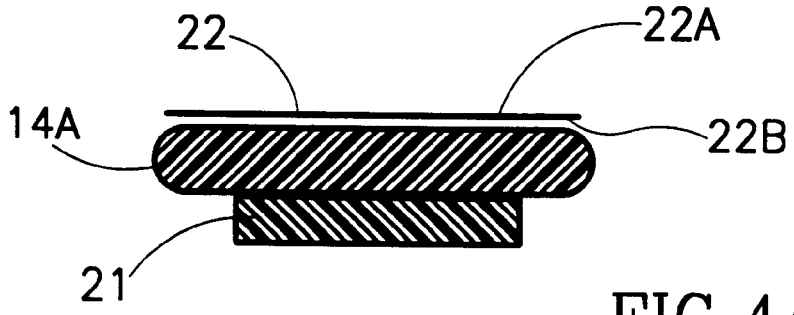
FIGS. 4A–4C are cross-sections taken along lines A—A, B—B and C—C, respectively of FIG. 2.
Figure 4B:
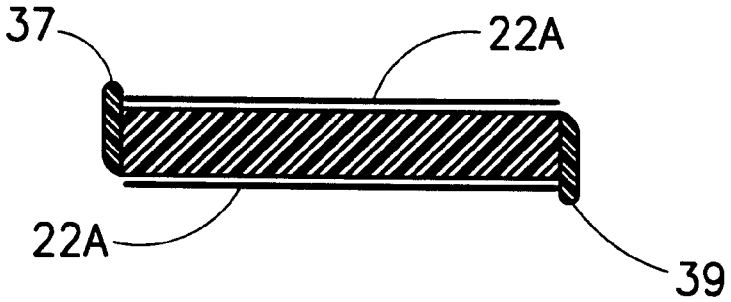
Figure 4C:
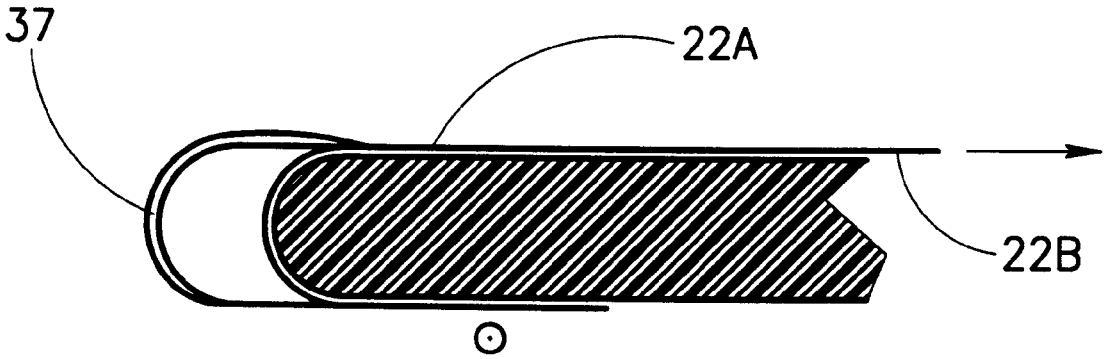

Reference is now made to FIGS. 4A–4C which are sectional details showing the construction of the legs 14*a* and 14*b*. As can be seen in the cross-section taken along line A—A (FIG. 4A), legs 14*a* and 14*b* are generally rectangular having generally flat upper and lower surfaces and rounded edges. Supporting means 21 are suitably fixed to the underside of legs 14*a* and 14*b* so that when lowered, there is a space between the underside and toilet bowl 19. Protective covering 22 rests on the upper surface of legs 14*a* and 14*b*.

The cross-section, taken along line B—B (FIG. 4B), illustrates the means for ensuring that the protective covering 22 does not slip off the seat 10. Upper and lower projecting nibs, referenced 37 and 39, respectively, are formed along the inner and outer edges of legs 14*a* and 14*b*, proximate to their respective ends 17*a* and 17*b*, respectively. Upper projecting nib 37 extends along the inner edge for a distance generally indicated by dimension "w". Lower projecting nib 39 extends along the outer edge for a distance not exceeding the length the leg overhangs the toilet bowl. Upper and lower projecting nibs, referenced 37 and 39, respectively, act in combination with legs 14*a* and 14*b*, so as to provide a track for the protective covering roll 22.

The section taken along line C—C (FIG. 4C), illustrates the crossover of protective covering 22 from the underside to the topside of seat 10 at ends 17*a* and 17*b*.

With reference to FIG. 3, housing 20 further comprises a feeder spool 44 located proximate to end 16*a* and a take-up spool 46 located proximate to end 16*b*.

Protective covering 22, which is typically in the form of a roll of constant width, may comprise any suitable material but preferably comprises a dual-ply material such as paper (upper side, referenced 22*a*) backed by a waterproof plastic based material (underside, referenced 22*b*).

The rotation of take-up spool 46, actuated by the operation of operating lever 30, advances protective covering 22, which is conveyed from feeder spool 44, along and on top of seat 10 (indicated by arrow 24*a*), under leg 14*a* proximate to end 17*a*, across gap 26, under leg 14*b* proximate to end 17*b*, along and on top of seat 10 (arrow 24*b*).

Feeder spool 44 sits on a tube 48, which is freely rotatable about its longitudinal axis, referenced 50. Tube 48 is suitably supported by a stand 52 which is suitably attached, by bolts or other similar fixing means, to supporting structure 18.

Take-up spool 46 sits on a second tube 54, which is freely rotatable about its longitudinal axis, referenced 55. Second tube 54 is supported by a shaft 56, which is connected to motor 28. Shaft 56 is suitably supported by a second stand 58. Stand 58 and motor 28 are both suitably attached, by bolts or other similar fixing means, to supporting structure 18.

Whenever a roll needs replacing, the used roll (on take-up spool 46) is removed. A new feeder spool 44, comprising a roll of the dual-ply protective covering 22, is placed on tube 48 and a strip of the material is drawn along seat 10 as indicated by arrows 24*a* and 24*b* and attached to take-up spool 46. The take-up spool 46 is rotated in a counter-clockwise motion to feeder spool 44 so that the waterproof side (22*b*) of the used roll which is on the outer side of the roll and face down when placed on the toilet seat 10, will be taken up so that it is on the inner side of the used roll. Thus a used roll can be easily distinguishable from a new roll.

Stand 52 supporting feeder spool 44 is fixed to supporting structure 18 so that it is aligned at an angle a relative to the longitudinal axis, referenced 60, of housing 20. Similarly, stand 58 is aligned at an angle β relative to the longitudinal axis 56. The stands 52 and 58 are aligned at angles α and β, respectively so that legs 14*a* and 14*b* converge towards each other so that the minimum distance "d" between the ends 17*a* and 17*b* of legs 14*a* and 14*b*, respectively, may be predetermined.

Operating lever 30 comprises a lever member 62 and a handle 64. One end of lever member 62 extends beyond housing 20 and connects to handle 64. The other end of lever member 62 is connected (preferably by mechanical means) to timing valve 36 (which is connected to the existing pressurized water supply system) in order to actuate the timing sequence of valve 36.

Motor 28 is any known motor which is operable by hydraulic power.

Figure 5:
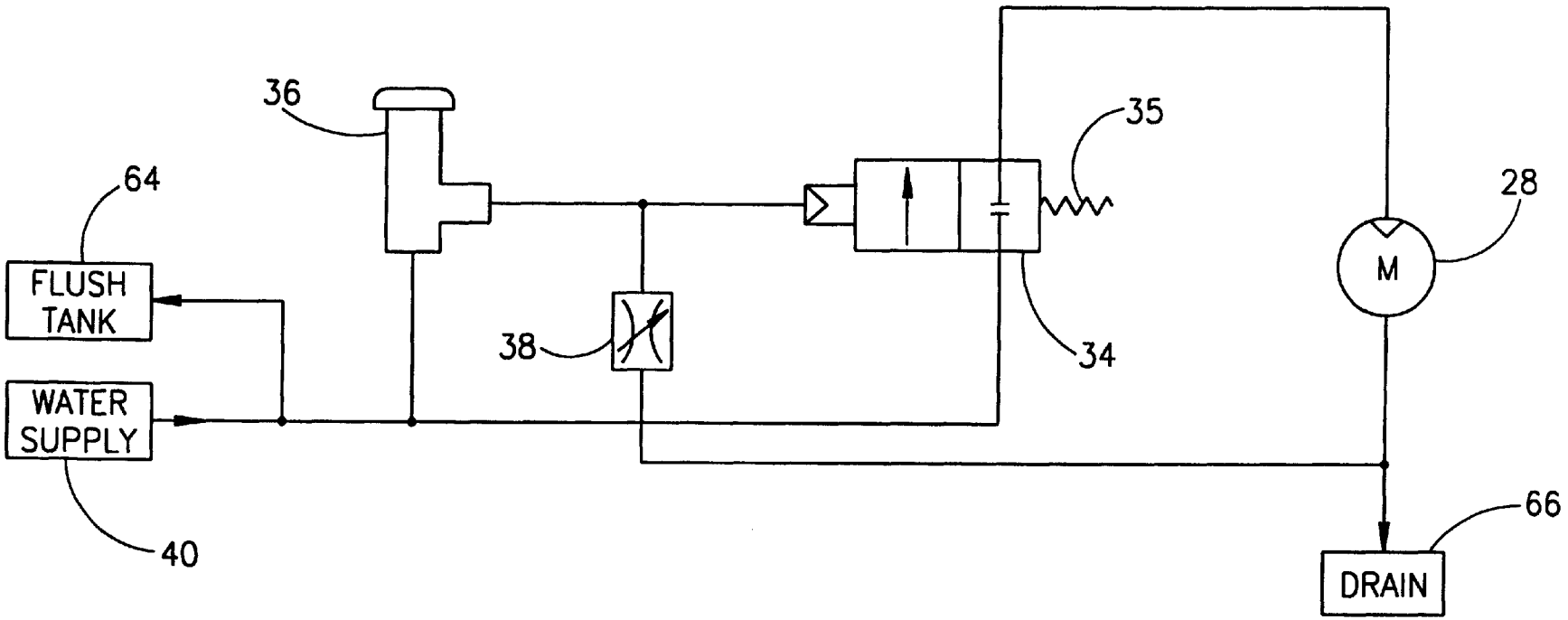
FIG. 5 is a detail schematic arrangement of the hydraulic components of FIG. 3.

Reference is now made to FIG. 5 which is a detailed schematic arrangement of the hydraulic components of toilet seat 10. It is a feature of the invention that the existing pressurized water supply system connected to the toilet is utilized to automatically feed the protective covering 22 along the seat 10. Electrically or battery operated means are not required.

The water supply 40 which is connected to the flush tank 64 of the toilet, is further connected to main valve 34 and timing valve 36. The outlet from leakage valve 38 is installed between main valve 34 and timing valve 36 and outlets to a drain 66. Hydraulic motor 28 is connected to main valve 34. Main valve 34 is a standard 2×2 valve or similar valve, known in the art, controlled by water pressure and a return spring 35. Timing valve 36 is a mechanically time-controlled flow valve, known in the art, for automatically shutting off the valve after a pre-determined time period may be spring actuated.

In operation, whenever operating lever 30 is pressed downwards, the timing sequence of timing valve 36 is actuated allowing water at pressure to flow from water supply 40, activating main valve 34, thereby operating hydraulic motor 28. During the period during which the timing valve 36 is open, the water pressure actuates motor 28 to rotate take-up spool 46 so that a length of protective covering 22, equivalent to the perimeter distance of the toilet seat 10, is pulled out from feeder spool 44 along the seat 10 to take-up spool 46, thereby to replace the previous length of protective covering 22.

Once the timing valve 36 has returned to its closed position, the control pressure drops allowing return spring 35 to close main valve 34, motor 28 ceases operation. Leakage valve 38 is open all the time and whenever there is a drop in pressure, such as when timing valve 36 is closed, water leaks away via drain 66.

It will be appreciated by persons skilled in the art that the present invention is not limited by what has been particularly shown and described herein above. Rather the scope of the invention is defined by the claims which follow:

We claim:

1. Apparatus for conveying a protective covering along a toilet seat, said apparatus comprising:

a toilet seat;

a housing attached to said toilet seat, said housing comprising:

a supporting structure for said toilet seat, said toilet seat having first and second legs, each leg of which is connected to said supporting structure;

a feeder spool positionable adjacent said first leg from which a roll of unused protective covering material is fed;

a take-up spool positionable adjacent said second leg for used protective covering;

a hydraulically operated drive mechanism operatively connected to said take-up spool for advancing a pre-determined length of said protective covering along and around said toilet seat from said feeder spool to said take-up spool; and apparatus for ensuring that said protective covering remains contiguous with said seat while said protective covering is being advanced, said apparatus comprising upper and lower projecting nibs formed on one end of each of said first and second legs.

2. Apparatus according to claim 1 and wherein said first and second legs are interconnected to said supporting structure whereby the action of lifting one of said legs also raises the second of said legs.

3. Apparatus according to claim 1 and wherein said take-up spool rotates in a counter-clockwise motion to said feeder spool.

4. Apparatus according to claim 1 and wherein said pre-determined length of said protective covering is conveyed from said feeder spool along and on top of said first leg, at the open end of said first leg under and across said second distance, under said second leg, and along and on top of said second leg to said take-up spool.

5. Apparatus according to claim 1 and further comprising hydraulically operated mechanism connected to said drive mechanism for actuating said drive mechanism, said hydraulically operated mechanism comprising:

a. a lever member;

b. a handle connected to one end of said lever member; and c. a time controlled flow valve, connected to the other end of said lever, for automatically shutting off said flow valve after a pre-determined time period.

6. Apparatus according to claim 1 and wherein said protective covering material comprises a dual-ply material.

7. Apparatus according to claim 6 and wherein said dual-ply material comprises a layer of waterproof material.

8. Apparatus according to claim 7 and wherein said layer of waterproof material remains contiguous with said toilet seat.

9. A method for conveying a protective covering, having first and second sides, along a toilet seat having first and second legs, whereby said first side of said protective covering remains contiguous with said toilet seat, the method comprising the steps of:

a. conveying said protective covering from said feeder spool along and on top of said first leg, said first side being contiguous with the top of said first leg;

b. at the open end of said first leg, turning over said protective covering under said first leg, said first side being contiguous with the underside of aid first leg;

c. conveying said protective covering across a gap between said first and second legs;

d. at the open end of said second leg, turning over said protective covering under said second leg, said first side being contiguous with the underside of said second leg; and e. conveying said protective covering along and on top of aid second leg to said take-up spool.

10. A method according to claim 9 and wherein said advancing step further comprises the steps of rotating said feeder spool in a first direction and rotating said take-up spool in a counter-clockwise motion to said feeder spool.

* * * * *